US008894425B2

(12) United States Patent
Thorner et al.

(10) Patent No.: US 8,894,425 B2
(45) Date of Patent: Nov. 25, 2014

(54) CONNECTION SYSTEM FOR CONNECTING A SINGLE ROW HOUSING TO A TERMINAL ELEMENT

(75) Inventors: Carsten Thorner, Melle (DE); Peter Stovesand, Oelde (DE); Thomas Oesselke, Brakel (DE)

(73) Assignee: Phoenix Contact GmbH & Co., KG (DE)

( * ) Notice: Subject to any disclaimer, the term of this patent is extended or adjusted under 35 U.S.C. 154(b) by 29 days.

(21) Appl. No.: 13/516,309

(22) PCT Filed: Dec. 16, 2010

(86) PCT No.: PCT/EP2010/069961

§ 371 (c)(1), (2), (4) Date: Aug. 27, 2012

(87) PCT Pub. No.: WO2011/073342

PCT Pub. Date: Jun. 23, 2011

(65) Prior Publication Data

US 2012/0315777 A1 Dec. 13, 2012

(30) Foreign Application Priority Data

Dec. 17, 2009 (DE) ..... 10 2009 059 011

(51) Int. Cl.
*H01R 25/00* (2006.01)
*H01R 9/26* (2006.01)

(52) U.S. Cl.
CPC ..... *H01R 9/2625* (2013.01)
USPC ..... 439/110

(58) Field of Classification Search
USPC ..... 439/110, 709, 76.1; 361/600–792
See application file for complete search history.

(56) References Cited

U.S. PATENT DOCUMENTS

| | | | | |
|---|---|---|---|---|
| 3,253,252 | A | 5/1966 | Piperato et al. | |
| 5,716,241 | A * | 2/1998 | Hennemann et al. | 439/716 |
| 5,741,142 | A | 4/1998 | Dux et al. | |
| 6,027,379 | A | 2/2000 | Hohorst | |
| 8,209,455 | B2 * | 6/2012 | Rasche et al. | 710/301 |
| 2009/0209131 | A1 * | 8/2009 | Murphy et al. | 439/607.35 |

FOREIGN PATENT DOCUMENTS

| | | |
|---|---|---|
| DE | 8803824 | 10/1988 |
| DE | 9420189.7 | 6/1995 |
| DE | 202007005385 | 7/2007 |
| DE | 102006057604 A1 | 5/2008 |
| RU | 2345507 C2 | 1/2009 |
| WO | WO 2004/068662 | 8/2004 |

OTHER PUBLICATIONS

International Bureau, English Translation of International Search Report for International Application No. PCT/EP/2010/069961, Jun. 23, 2011, pp. 1-2, Geneva, Switzerland.

(Continued)

*Primary Examiner* — Jean F Duverne
(74) *Attorney, Agent, or Firm* — Ohlandt, Greeley, Ruggiero & Perle, L.L.P.

(57) ABSTRACT

The invention relates to a connection system for connecting a single-row housing (12) to a terminal element (10), a terminal region (22) being provided on the single-row housing (12) for connecting the terminal element (10) to the single-row housing (12), the terminal region (22) being connected to a printed circuit board provided in the single-row housing (12). According to the invention, the terminal element (10) can be secured to the terminal region (22) by means of a plug contact (24).

9 Claims, 1 Drawing Sheet

(56) References Cited

OTHER PUBLICATIONS

International Bureau, English Translation of the Written Opinion of the International Search Authority for International Application No. PCT/EP/2010/069961, Mar. 27, 2012, pp. 1-4, Geneva, Switzerland.

International Bureau, English Translation of International Preliminary Report on Patentability Chapter I for International Application No. PCT/EP/2010/0069961, Jul. 4, 2012, pp. 1-5, Geneva, Switzerland.

Russian Office Action for RU2012124524 dated May 30, 2014 with English translation (5 Pages).

* cited by examiner

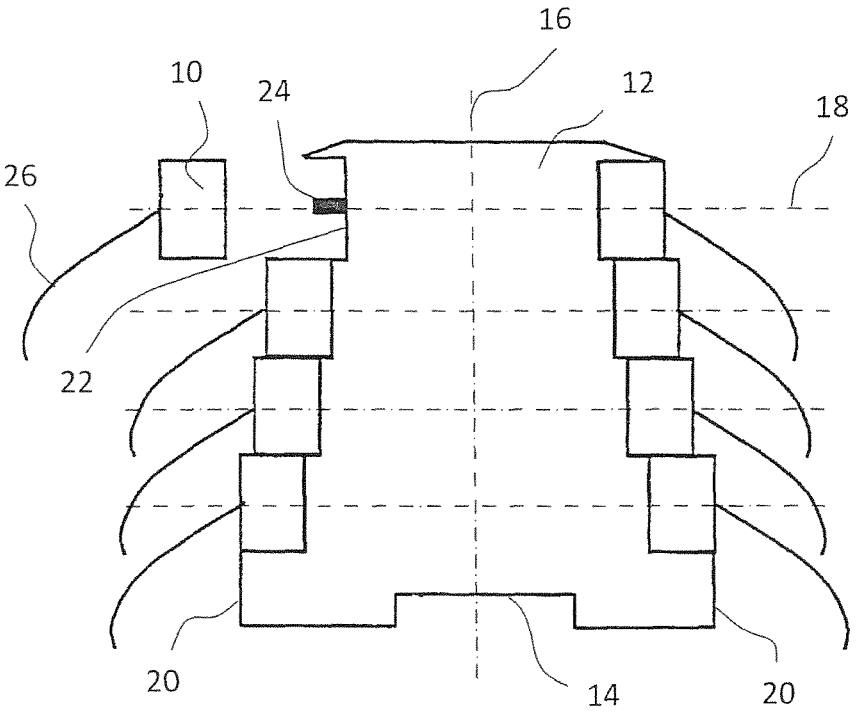
16
10
24
12
18
26
22
20
14
20

CONNECTION SYSTEM FOR CONNECTING A SINGLE ROW HOUSING TO A TERMINAL ELEMENT

CROSS-REFERENCE TO RELATED APPLICATIONS

This application is a United States national stage entry of International Application serial no. PCT/EP2010/069961 filed Dec. 16, 2010, which claims priority to German patent application no. 10 2009 059 011.0 filed Dec. 17, 2009. The contents of both of these prior applications are incorporated herein by reference in their entirety as if set forth verbatim.

FIELD

The innovation applies to a connection system to connect a single-row housing with a connecting element.

BACKGROUND

For example, a single-row housing is known from DE 10 2006 057 604 A1, whereby the single-row housing is designed as an electrical constructional unit for the industrial control technology for an arrangement in switch cabinets. The single-row housing can be attached to a mounting rail, such as a cap rail. The single-row housing has a significantly greater length than width, whereby the longitudinal axis of the single-row housing that is designed along the length of the single-row housing mainly extends vertically to the longitudinal axis of the mounting rail. The single-row housing has multiple levels along its longitudinal axis, whereby the levels run vertically to the longitudinal axis. The width of the single-row housing is thereby designed so that one connection area is designed for each level to the broadside of the single-row housing.

The connection area is the area on which a connecting element can be attached to the single-row housing. Usually, the connection area has a connection clamp in form of a screw-type terminal or spring-loaded terminal, with is used to attach the connection element or a conductor to the housing.

However, a disadvantage here is that because of the provision of a connecting clamp in form of a screw-type terminal or spring loaded terminal the connecting element can only be attached to the connection area with a time consuming method utilizing a tool.

Therefore, the innovation is based on the task to provide a connection system to connect a single-row housing with a connecting element, which is marked by simplified manageability.

SUMMARY

The solution for the task occurs according to the innovation by utilizing the characteristics of claim 1. Advantageous designs of the innovation are indicated in the sub-claims.

The connection system according to the innovation to connect a single-row housing to a connecting element has a connection area to connect the connecting element with the single-row housing that is provided on the single-row housing, whereby the connection area is connected to a printed circuit board that is provided in the housing.

According to the innovation, the connecting element can thereby be attached to the connection area with a plug contact.

Because the connecting element can be attached to the connection area with a plug contact, the connecting element can be attached to the single-row housing and/or connection area of the single-row housing in a short period of time and without having to utilize a tool.

The plug contact is thereby preferably designed as a conductive electromechanical contact, which is connected at the initial ending of the electronics that are arranged within the housing, such as a printed circuit board. The plug contact is connected with the connecting element with an end that is positioned across from the first end. The connecting element can preferably be connected with a conductor, which could be mounted on the connecting element with, for example, a screwed connection, spring load connection or direct-push-in-connection. The conductors can thereby no longer directly attached to the connecting area of the single-row housing as is provided with the known state-of-the-art, but with an additional connecting element, which can simply be attached to the connecting area of the single-row housing to establish an electrical contact. The need for cumbersome inserting of the conductor in the single-row housing with a very small width at the broadside of the housing and attachment to connecting clamp provided there is thereby eliminated.

According to an advantageous design of the innovation, the plug contact is designed as a pin. For example, the plug contact can thereby have a circular or rectangular cross-section. Because the plug contact is designed as a pin, an especially simple and fast attachment and/or connection of the connecting element to the connection area is made possible.

Another preferred provision is that the plug contact is attached to the connecting area of the single-row housing and that the connecting element has an opening to plug in the plug contact or that the plug contact must be attached to the connecting element and the connecting element of the single-row housing has an opening to insert the plug contact. When the connecting element is attached to the connecting area, the plug contact can easily be inserted in the corresponding opening, whereby the length of the opening preferably mainly corresponds with the length of the plug contact so that the plug contact can be inserted completely into the opening. The plug contact is thereby completely protected from the environment so that secure contacts are ensured.

Another preferred design is that a fastening element is provided to secure the connecting element on the single-row housing. The fastening element must preferably be designed in form of a snap arm, which can be latched in a corresponding aperture that is provided for this purpose. Preferably, the fastening element is designed so that extraction forces >15 N are required to be able to release the connection with the fastening element. Several fastening elements can thereby be provided to secure the connecting element on the single-row housing. For example, the fastening element can thereby be arranged on the connecting area of the single-row housing, whereby the corresponding aperture for this purpose is then provided on the connecting element. However, a possible alternative is to arrange the fastening element on the connecting element, whereby the corresponding aperture for this purpose is provided at the connecting area of the single-row housing. The fastening element makes an additional securing of the connection of the connecting element on the connecting area possible.

According to another advantageous design of the innovation, the single-row housing can be attached on a mounting rail, whereby the plug contact is mainly provided with its longitudinal axis vertical to the longitudinal axis of the mounting rail. The connecting element can thereby be attached on the side on the broadside of the single-row housing, which extends across the width of the single-row housing. When multiple single-row housings are attached to the mounting rail in sequence, the connecting elements can subsequently also easily be attached to the connecting area in the secured state of the single-row housing on the mounting rail without making managing of the mounting rail more difficult. The plug direction to connect the single-row housing with the connecting element is therefore designed vertical to the longitudinal axis of the mounting rail.

It is preferred to provide more than one connecting area on the single-row housing whereby the more than one connecting areas are arranged on top of each other on one of the broadsides of the housing. Because multiple connecting areas are arranged on top of each other, connecting areas may be provided across the entire length of the single-row housing along the side area, especially the broadside of the single-row housing, which results in that several connecting elements can be connected to the housing with one plug contact each across the length of the single-row housing on both of its broadsides.

It is thereby especially preferred that at least one connecting element is designed so that it can be attached on at least two connecting areas that are arranged on top of each other along a broadside of the single-row housing. The connecting element thereby preferably has two or more plug contacts or openings that are arranged on top of each other so that multi-contacting can occur using a connecting element.

To make a clear assignment of the connecting element to the corresponding connecting area possible, another preferred design of the innovation has an encoding of the connecting area. For example, the encoding may occur in form of color coding and/or numerical and/or alphabetical encoding and/or mechanical encoding. For example, because of the encoding, a clear assignment of the corresponding connecting element to the connecting area that is provided for this purpose can be ensured after releasing the connection so that faulty wiring can be prevented.

Furthermore, there is a preferred provision that at least one single-row housing must be arranged in series behind a second single-row housing whereby a connecting element is provided, which can be secured in a first connecting area of the first housing and a second connecting area of the second housing at the same time. This makes it possible to contact multiple connecting areas on different housings with one connecting element, whereby it is preferred that multiple connecting areas that are provided on a level along the cross-axis of the housings of multiple housings can be contacted with a connecting element.

The innovation is explained in more detail below in reference to the attached drawing based on a preferred design.

BRIEF DESCRIPTION OF THE DRAWINGS

The following is shown:

FIG. 1 a connection system according to a design in compliance with the innovation.

DETAILED DESCRIPTION

FIG. 1 shows a connection system according to the innovation to connect multiple connecting elements 10 with a single-row housing 12. The single-row housing 12 can be secured on its bottom side 14 to a mounting rail, which is not shown here, whereby the longitudinal axis 16 of the single-row housing 12 is designed perpendicular to the longitudinal axis of the mounting rail. The single-row housing 12 has multiple levels 18, which are designed vertical to the longitudinal axis 16 of the single-row housing. For each level 18, two each connecting elements 10 across from each other are arranged on the side at the broadsides 20 of the single-row housing 12. Single-row housing 12 hereby means that only one connecting element 10 is to be arranged for each level 18 and for each broadside 20. The single-row housing 12 thereby preferably has a width along a broadside 20 of 5 to 7 mm.

FIG. 1 shows seven connecting elements 10 connected to the single-row housing 12, whereby a connecting element 10 is shown released from the single-row housing 12. The connecting elements 10 can be attached to one connection area 22 provided on each of the single-row housing 12, whereby the connection area 22 is provided on the broadside 20 of the housing 10. A pin shaped plug contact 24 is provided on connection area 22, to which the connecting element 10 can be connected to establish a contact between the connecting element 10 and a printed circuit board that is arranged in the single-row housing 12, not shown here, whereby the plug contact 24 and/or the connection area 22 is connected with the printed circuit board within the single-row housing 12. The plug contact 24 is preferably designed with its longitudinal axis perpendicular to the longitudinal axis 16 of the single-row housing 12 so that the connecting elements 10 can be fastened on the side of the broadside 20 of the single-row housing 12 without the use of tools. On the connecting elements 10 themselves, a conductor 26 can in turn preferably be attached with a screwed connection, clamping force connection or a direct push-in connection.

REFERENCE LIST

Connecting element 10
Single-row housing 12
Bottom side 14
Longitudinal axis 16
Level 18
Broadside 20
Connection area 22
Plug contact 24
Conductor 26

What is claimed is:

1. A connection system to connect a single-row housing with a connecting element, the connection system comprising:

a single-row housing having a top, a bottom and two opposite sides, the single row housing secured on the bottom to a mounting rail having a longitudinal axis, the single-row housing having a housing axis substantially perpendicular to the longitudinal axis of the mounting rail, the single-row housing having a plurality of levels disposed between the top and the bottom, each level having a face disposed on each opposite side to provide a plurality of faces, each face substantially parallel to the housing axis and having a single contact, the plurality of faces and contacts providing a plurality of connection areas on the single-row housing, each connection area provided for connecting one connecting element with the single-row housing, wherein the each connection area is connected with an electrical or electronic assembly in the single-row housing, and wherein the connecting element can connect to the connection area with the single contact being a plug contact.

2. The connection system according to claim 1, wherein the plug contact is a pin shape.

3. The connection system according to claim 1, wherein the plug contact is fastened on the connection area and the connecting element has an opening that can accept the plug contact or the plug contact is secured on the connecting element and the connection area has an opening that can accept the plug contact.

4. The connection system according to claim 1, wherein a fastening element is provided to secure the connecting element on the single-row housing.

5. The connection system according to claim 1, wherein the single-row housing can be secured on a mounting rail, wherein the plug contact is provided with a longitudinal axis substantially perpendicular to the longitudinal axis of the mounting rail.

6. The connection system according to claim 1, wherein more than one connection area is provided on the single-row housing, wherein the more than one connection areas are-vertically disposed to each other along a longitudinal axis of the single row housing on a side area of the single-row housing.

7. The connection system according to claim 6, wherein at least one connecting element can be secured on at least two connection areas that are vertically disposed to each other along the longitudinal axis of the single row housing at the same time.

8. The connection system according to claim 1, wherein the connection area is provided with encoding.

9. The connection system according to claim 8, wherein the encoding is a mechanical encoding.

* * * * *